United States Patent [19]

Wehde et al.

[11] 4,242,860

[45] Jan. 6, 1981

[54] YARN MONITORING APPARATUS FOR AN OPEN END SPINNING TURBINE

[75] Inventors: Heinz Wehde, Rothenberg; Burkhard Wulfhorst; Fritz Schumann, both of Ingolstadt, all of Fed. Rep. of Germany

[73] Assignee: Teldix GmbH, Heidelberg, Fed. Rep. of Germany

[21] Appl. No.: 972,713

[22] Filed: Dec. 14, 1978

[30] Foreign Application Priority Data

Dec. 14, 1977 [DE] Fed. Rep. of Germany ..... 2755647

[51] Int. Cl.[3] ..... D01H 13/16; D01H 13/18; G08B 21/00

[52] U.S. Cl. ..... 57/81; 57/83; 57/264; 57/265; 340/664; 364/470; 364/483

[58] Field of Search ..... 57/58.89–58.95, 57/80, 81, 83, 100, 264, 265; 340/664; 364/470, 483, 552

[56] References Cited

U.S. PATENT DOCUMENTS

| | | | |
|---|---|---|---|
| 3,316,699 | 5/1967 | Mattingly | 57/100 X |
| 3,704,579 | 12/1972 | Tooka et al. | 57/58.89 X |
| 3,738,095 | 6/1973 | Lohest | 57/100 |
| 3,972,171 | 8/1976 | Handschuch et al. | 57/58.89 |
| 4,016,713 | 4/1977 | Lauger et al. | 57/100 |
| 4,117,359 | 9/1978 | Wehde | 57/100 X |
| 4,158,284 | 6/1979 | Wehde | 57/265 |

*Primary Examiner*—John Petrakes
*Attorney, Agent, or Firm*—Spencer & Kaye

[57] ABSTRACT

An apparatus for monitoring the yarn delivered by an open end spinning turbine which has an electric motor for driving the turbine with a predetermined rpm. The apparatus includes a measured value transmitting arrangement responsive to changes in the current consumption of the electric motor for generating a signal when the change in the current consumption exceeds a predetermined threshold value. The measured value transmitting arrangement is responsive to a reduction in the current consumption of the electric motor and generates a yarn breakage indicating signal when the reduction in the current consumption falls below a predetermined value indicative of yarn breakage.

8 Claims, 3 Drawing Figures

YARN MONITORING APPARATUS FOR AN OPEN END SPINNING TURBINE

BACKGROUND OF THE INVENTION

This invention relates to an apparatus for monitoring the thread drawn off an open end spinning turbine which is driven with a predetermined rpm by a motor, particularly a brushless DC motor. The apparatus has a measured value transmitter which responds to variations of the current consumption of the motor and generates a signal when the current variation exceeds a predetermined threshhold value.

In U.S. patent application Ser. No. 863,156, filed Dec. 22, 1977, now U.S. Pat. No. 4,158,284, it has been proposed to utilize the variations of the motor current to detect thickened yarn portions caused by a localized soiling of the rotor groove or to detect variations in the yarn structure caused by groove wear or a wide-spread deposition of dirt in the groove. As the yarn is drawn off the groove, yarn irregularities, for example, thickened locations cause, because of the altered yarn mass (change in friction) and because of the altered (increased) air resistance of the yarn, a change of motor torque and thus a change in the current consumption of the spinning motor.

SUMMARY OF THE INVENTION

It is an object of the invention to provide an improved apparatus of the above-outlined type of ensuring by simple means a monitoring of the yarn made by an open end spinning turbine having a direct electric drive comprising, in particular, a brushless DC motor.

This object and others to become apparent as the specification progresses, are accomplished by the invention, according to which, briefly stated, the apparatus includes a measured value transmitter which responds to the drop in the current consumption of the spinning turbine motor upon yarn breakage in accordance with a predetermined value and thereupon generates a yarn breakage indicating signal.

A further monitoring task is performed by a measured value transmitter which responds to an increase or a decrease in the current consumption in accordance with a predetermined value and predetermined delays and thereupon generates a shutoff signal or a warning signal.

Yarn monitors which emit a switching signal when the yarn is absent are known by themselves. The arrangements known heretofore include a sensor which operates mechanically, optically, or capacitively and monitors the presence of the yarn drawn from the spinning turbine. Mechanical yarn sensors, however, may tend to roughen the yarn, resulting in a hairy appearance thereof. Yarn sensors operating on optical or capacitive principle are, on the other hand, very expensive and are further sensitive to environmental and operational conditions which may effect their sensitivity of response.

In contradistinction to the above-outlined prior art arrangements, the invention has the advantage that a monitoring of yarn breakage is made possible by means of a simple current measurement; this operation neither affects the quality of the yarn nor is influenced by environmental conditions. The additional devices that have been required heretofore may be dispensed with, while a current measuring involves no particular additional expense since the pre-conditions for performing such a current measuring operation are already present by the use of a direct electric drive of the spinning rotor. Thus, a simple and reliable "no-contact" monitoring device is provided for the yarn.

The invention is based on the recognition that the current consumption of the motor, which drives the spinning rotor varies as a function of the yarn mass introduced into and withdrawn from the spinning rotor and thus the current consumption varies as a function of the resulting additional rotational work and friction. The finer the yarn (as indicated by its Nm number), the less current consumed by the motor. Considering, for example, the current consumption of a motor which rotates its spinning rotor with 50,000 rpm, there is a 20% drop in the current consumption between handling an Nm 10 yarn, on the one hand, and an Nm 30 yarn, on the other hand. A further drop in the motor consumption occurs when the spinning rotor runs without fiber material therein. In case such an idling run of the spinning rotor occurs during the making of an Nm 30 yarn, on the one hand, or an Nm 10 yarn, on the other hand, the current consumption drops by 20% in the former case and by 30% in the latter case. Such a drop in the motor consumption to a lower limit value occurs suddenly upon yarn breakage and is an indication that yarn breakage did in fact occur. If such a limit value is predetermined, the lowering of the current consumption to the predetermined value may be utilized to generate a signal which is then interpreted as yarn breakage. Typically, yarn breakage occurs when the yarn has a thinned location. If the yarn drawing tension is greater than the local breaking strength of the thinner location, a yarn breakage occurs. Yarn breakage may also occur upon fluctuation or discontinuity of the fiber feed into the spinning turbine.

In order to eliminate short-period transitional current variations caused, for example, by switching operations, according to a further feature of the invention, means are provided to indicate whether the drop of the motor current persists for a predetermined period. This arrangement ensures that erroneous signaling or switching are eliminated. The yarn breakage signal may be used as a warning signal. Preferably, however, the yarn breakage signal is used to shut off the fiber feed or, if desired, the entire spinning station and additionally an optical or acoustic signal is emitted to draw attention to the yarn breakage. Such a warning signal may also be applied to a central monitoring station. Preferably, the frequency of occurrence of the yarn breakage signal is sensed by a counter to draw attention relatively rapidly to spinning stations where, for some reason, frequent yarn breakages occur. Yarn breakages during the spinning start should be ignored; for this reason, the counter input is closed during the starting phase of the spinning operation. For performing the measurement, a resistor contained in the current feed conduit for the motor may be used, together with after-connected means for recognizing a yarn breakage-caused drop in the voltage measured across the resistor. Such devices, with the exception of the resistor, may serve a plurality of motors if the monitoring is performed in a multiplex operation. It is to be understood that other types of current measuring processes may also find application for practicing the invention.

DESCRIPTION OF THE PREFERRED EMBODIMENT

Figure 1:
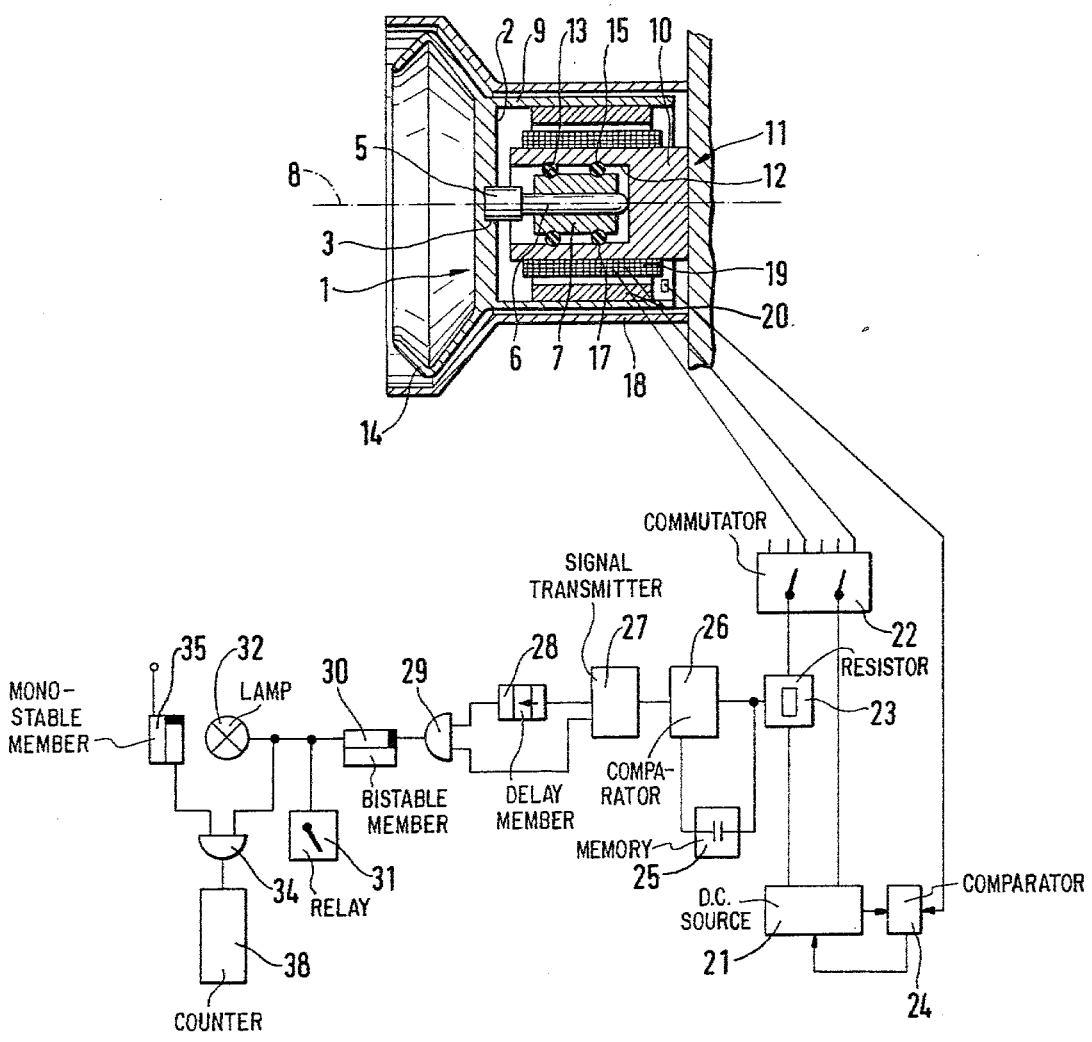
FIG. 1 schematically illustrates, in axial section, an open end spinning turbine with its drive motor incorporated therein, as well as a block diagram of a yarn monitoring apparatus connected to the turbine and constituting a preferred embodiment of the invention.

Turning now to FIG. 1, there is shown an open end spinning turbine having a rotor 1, comprising a radial bottom wall 2 and a cylindrical, sleeve-like portion 9 extending rearwardly from the bottom 2. The bottom 2 is provided with a blind bore 3 receiving the cylindrical base portion 5 of a pin 6 extending into a bearing sleeve 7. The center of gravity of the rotor 1 is at least approximately on the axis of symmetry 8 in the zone of the pin bearing which contains the bearing sleeve 7 as well as the pin 6. A stator component 10 of the stator 11 projects into the rotor sleeve 9 and is provided with a blind bore 12 for receiving the bearing sleeve 7. The bearing sleeve 7 is positioned in the bore 12 by means of elastic components, such as O-rings 13. The O-rings 13 are accommodated in aligned, complemental circumferential grooves 15 and 17, provided in the bore 12 and in the bearing sleeve 7, respectively.

For driving the spinning rotor 1, there is provided an electromotor which comprises permanent magnets 20 affixed to the inner face of the rotor sleeve 9. The substantially radially magnetized permanent magnets 20 have alternating polarities in the circumferential direction and are secured to the rotor as individual magnets. These permanent magnets are arranged adjacent current-carrying windings 19 which are mounted on the stator 10. Thus, the rotor is driven in the fashion of a brushless DC motor. The windings 19 are coreless, so that the electromotor does not generate additional forces or torques on the motor bearing. The forward end of the rotor is shaped as a funnel 14, into which the material to be spun is deposited in a known manner and then the produced yarn is withdrawn. If the center of gravity of the rotor, for example, because of manufacturing tolerances or because of the eccentricity of the fiber material in the funnel 14, is not situated precisely on the axis of symmetry 8, the rotor may nevertheless rotate about its main axis of inertia by virtue of the floating bearing while additional bearing forces are avoided. By virtue of designing the drive as a coreless electromotor it is further achieved, that the drive does not exert any additional radial forces or torques on the bearing also if the rotor turns about an axis which does not precisely coincide with the axis 8.

The motor winding 19 is assumed to be a 3-phase winding. The three phases are sequentially connected to an adjustable DC source 21 by means of a commutator 22 which operates in a conventional manner and is therefore not described in more detail. The component 24 compares a signal which characterizes the rpm of the rotor 1 and which is generated, for example, by an inductive measured value transmitter, with a signal characterizing a desired rpm and, as a result, generates a signal for regulating the motor current based on a desired rpm. Such a regulation is also conventional and therefore need not be described in detail.

The current supply circuit contains a resistor 23, across which a potential difference is measured which is a function of the motor current intensity. In case yarn breakage occurs, the motor current, as it was discussed above, drops and thus likewise the voltage measured across the resistor 23 also decreases.

The voltage sensed across the resistor 23 during operation is stored by means of a memory 25. In a comparator 26 the momentarily sensed voltage is compared with the stored voltage. At the output of the comparator 26 a signal appears which corresponds to the deviation of the momentarily sensed voltage from the stored voltage value. If the magnitude of this signal exceeds a value set in a signal transmitter 27 such that the stored signal exceeds the momentarily sensed signal by the predetermined value, the component 27 emits a signal. The latter is delayed, for example, for 0.5 second by a delay component 28. If, upon appearance of the delayed signal, the output signal of the component 27 is still present (which means that the state of current reduction continues), by means of an AND-gate 29 a bistable member 30 is set, which delivers a signal to a relay 31 for shutting off the fiber feed and further delivers a warning signal to a warning lamp 32. The delay is so designed that short-period disturbances are ignored. Instead of a signal comparison, it is feasible to perform a differentiation for recognizing a reduction of the voltage measured across the resistor 23.

Further, the signal appearing at the output of the bistable member 30 is also applied to a counter 38, which thus records the occurring yarn breakages and may trigger a shut-off of the spinning unit when a preselected arbitrary breakage number has been reached. In order to cause the apparatus to disregard yarn breakages during spinning restarts (which do not constitute malfunctions) there is provided an AND-gate 34 which, in the normal position of a monostable member 35, is in a transmitting state. When, however, spinning restart occurs, the AND-gate 34 blocks during a period predetermined by the time constant of the monostable member 35, so that at the beginning of spin start, the monostable member 35 is set.

An additional monitoring task which is effected by measuring the variation of the current consumption of the spinning motor, is a continuous sensing of fluctuations of the yarn number in excess of a permissible tolerance range. Such fluctuations occur, for example, in case of long-term (long wave) defects in the stored fiber material or, because of an incorrect starting operation, as a result of which dual webs are simultaneously fed into the turbine.

As it has been discussed before, the current consumption of the motor deviates by 20% if the turbine handles an Nm 30 yarn as compared to an Nm 10 yarn. This clearly indicates that even in case of small, long-period fluctuations, a recognizable change in the current consumption of the motor occurs.

If thus during a predetermined period, the current consumption exceeds a predetermined tolerance range, such an occurrence is an indication that defective fibers are fed to the turbine. By known appropriate measures the increase or drop in the current consumption with respect to a predetermined value may be determined over a predetermined period, whereupon a pulse is generated for triggering a warning or switching signal. In this manner an undetected occurrence of impermissible deviations in the yarn number is prevented. It is further feasible to apply the output signal of the comparator 26 generated in the above-described manner, to an evaluating device which determines the uniformity of the yarn.

The apparatus according to the invention makes it possible to monitor, by means of a single measured value transmitter, the entire yarn production in the manner described above so that defects in the spinning process are immediately noticed. The apparatus according to the invention thus makes possible a monitoring of the yarn production regarding yarn breakage and yarn number oscillations so that conventional and only randomly performed laboratory measurements or quality control can be automatically eliminated and thus an evaluation of the entire yarn manufacturing process is feasible.

An alteration of the current consumption of the motor which drives the spinning rotor occurs, however, not only in case of defects in the spinning process, but also in case of changes in the conditions of the bearings or the drive. Thus, for example, damages to the bearings lead to increased frictional forces and thus to an increase in the current consumption. If such a current consumption exceeds a predetermined value, the spinning stations are stopped and a warning signal is emitted. Mechanical components of the spinning device are thus in this manner protected from major damage so that in addition to a quality control of the yarn, there is achieved an overall monitoring system for the machinery.

Figure 2:
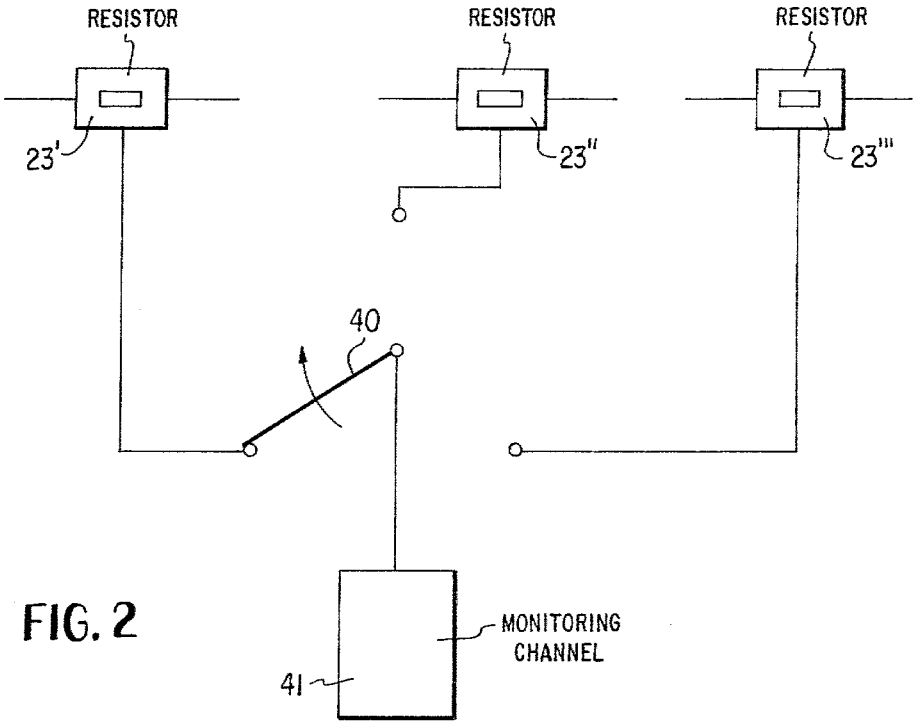
FIG. 2 is a schematic block diagram of a monitoring circuit for multiplex operation.

As mentioned above, a multiplex operation of a monitoring device is possible. In this connection reference is made to FIG. 2 where three resistors 23', 23'' and 23''' corresponding to the resistor 23 of FIG. 1 are provided, belonging to three different spinning turbines (not shown). The resistors 23', 23'' and 23''' are connected to a rotating switch-arrangement 40 which selectively connects the three resistors to a monitoring channel 41 which may be similar to the arrangement of FIG. 1.

Figure 3:
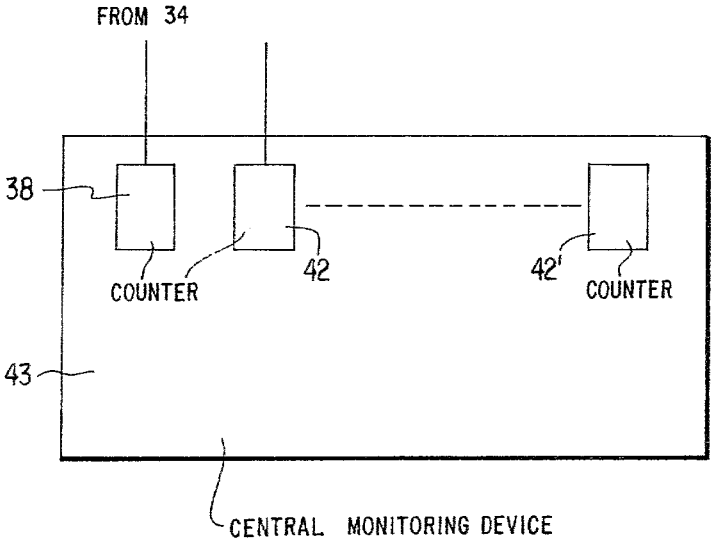
FIG. 3 is a schematic block diagram of a central monitoring device.

The counter 38 of FIG. 1 may be provided—as shown in FIG. 3—together with other counters 42, 42' belonging to other spinning turbines in a central monitoring device 43 by means of which a plurality of spinning turbines may be monitored.

It is to be understood that the above description of the present invention is susceptible to various modifications, changes and adaptations, and the same are intended to be comprehended within the meaning and range of equivalents of the appended claims.

What is claimed is:

1. In an apparatus for monitoring the yarn delivered by an open end spinning turbine including an electric motor for driving the open end spinning turbine with a predetermined rpm; the apparatus including a measured value transmitting means responsive to changes in the current consumption of the electric motor for generating a signal when the change in the current consumption exceeds a predetermined threshhold value; the improvement wherein said measured value transmitting means includes sensing means responsive to a reduction in the current consumption of said electric motor and signal generating means operatively connected to said sensing means for generating a yarn breakage indicating signal when the reduction in the current consumption of said electric motor falls below a predetermined value indicative of yarn breakage.

2. An apparatus as defined in claim 1, wherein said measured value transmitting means comprises a delay component operatively connected to said signal generating means for preventing said signal generating means from operating until the duration of the state of current change has reached a predetermined period.

3. An apparatus as defined in claim 1, further comprising means operatively connected to said signal generating means for receiving said yarn breakage indicating signal and for shutting off fiber delivery to said open end spinning turbine upon receipt of said yarn breakage indicating signal.

4. An apparatus as defined in claim 3, further comprising warning means operatively connected to said signal generating means for applying said yarn breakage indicating signal to said warning means for emitting a warning signal.

5. An apparatus as defined in claim 1, further comprising a central monitoring device operatively connected to said signal generating means for receiving the yarn breakage indicating signal therefrom.

6. An apparatus as defined in claim 1, further comprising a counter operatively connected to said signal generating means for adding the yarn breakage indicating signals.

7. An apparatus as defined in claim 6, further comprising means connected to said counter for blocking said counter for the duration of the starting phase of the spinning operation of the open end spinning turbine.

8. An apparatus as defined in claim 1, wherein said measured value transmitting means serves at least in part a plurality of open end spinning turbines; further comprising switching means for selectively connecting said measured value transmitting means to a desired one of said open end spinning turbines.

* * * * *